US009084331B2

(12) United States Patent
Li et al.

(10) Patent No.: US 9,084,331 B2
(45) Date of Patent: Jul. 14, 2015

(54) ACTIVE MATRIX ORGANIC LIGHT EMITTING DIODE CIRCUIT AND OPERATING METHOD OF THE SAME

(71) Applicant: AU Optronics Corporation, Hsin-Chu (TW)

(72) Inventors: Sheng-Han Li, Hsin-Chu (TW); Chun-Yen Liu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 13/933,200

(22) Filed: Jul. 2, 2013

(65) Prior Publication Data

US 2014/0049169 A1 Feb. 20, 2014

(30) Foreign Application Priority Data

Aug. 14, 2012 (TW) ..... 101129390 A

(51) Int. Cl.
*G09G 3/30* (2006.01)
*H05B 33/08* (2006.01)
*G09G 3/32* (2006.01)

(52) U.S. Cl.
CPC ..... *H05B 33/0896* (2013.01); *G09G 3/3233* (2013.01); *G09G 2300/0819* (2013.01); *G09G 2300/0852* (2013.01); *G09G 2300/0861* (2013.01)

(58) Field of Classification Search
USPC ..... 345/76, 77, 82, 690
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,580,408 | B1 * | 6/2003 | Bae et al. | 345/76 |
| 7,940,233 | B2 * | 5/2011 | Kim et al. | 345/76 |
| 8,159,421 | B2 * | 4/2012 | Hwang et al. | 345/76 |
| 2005/0269959 | A1 | 12/2005 | Uchino et al. | |
| 2006/0187153 | A1 * | 8/2006 | Nathan et al. | 345/76 |
| 2007/0103419 | A1 | 5/2007 | Uchino et al. | |
| 2007/0132694 | A1 | 6/2007 | Uchino et al. | |
| 2007/0164962 | A1 | 7/2007 | Uchino et al. | |
| 2010/0073352 | A1 * | 3/2010 | Inukai | 345/212 |
| 2011/0141000 | A1 | 6/2011 | Han et al. | |
| 2011/0273420 | A1 | 11/2011 | Liu | |
| 2012/0056866 | A1 * | 3/2012 | Lee et al. | 345/212 |
| 2013/0271435 | A1 | 10/2013 | Uchino et al. | |

FOREIGN PATENT DOCUMENTS

TW 200614146 5/2006

* cited by examiner

*Primary Examiner* — Tung X Le
(74) *Attorney, Agent, or Firm* — WPAT, PC; Justin King

(57) ABSTRACT

An active matrix organic light emitting diode (AMOLED) circuit and an operating method thereof are disclosed herein. The AMOLED circuit includes an organic light emitting diode, a switching circuit, a compensating circuit, a driving circuit, and a reset circuit. The compensating circuit is connected to the switching circuit and includes a first capacitor. The driving circuit is configured to be driven by the compensating circuit to provide the organic light emitting diode with a driving current. The reset circuit is connected to both ends of the first capacitor and to a control line. The reset circuit is configured to change the voltage levels on both ends of the first capacitor according to the voltage level on the control line, such that one end of the first capacitor and a reference power supply are conducted and charges stored inside the first capacitor are released.

20 Claims, 11 Drawing Sheets

ACTIVE MATRIX ORGANIC LIGHT EMITTING DIODE CIRCUIT AND OPERATING METHOD OF THE SAME

RELATED APPLICATIONS

This application claims priority to Taiwan Application Serial Number 101129390, filed Aug. 14, 2012, which is herein incorporated by reference.

BACKGROUND

1. Field of Invention

The disclosure relates to a diode circuit and an operating method thereof. More particularly, the disclosure relates to an active matrix organic light emitting diode circuit and an operating method thereof.

2. Description of Related Art

In recent years, with the development of display technology, a flat panel displayer has been widely used in daily life. An active matrix organic light emitting diode (AMOLED) displayer has become very popular with its features of high image quality, high contrast and high response speed.

FIG. 1 is a schematic diagram of an AMOLED displayer 10 of the prior art. The AMOLED displayer 10 includes a data driver 20, a scan driver 30 and a display area 40. The data driver 20 controls data lines, e.g., DL_1, DL_2, etc. The scan driver 30 controls scan lines, e.g., SL_1, SL_2, etc. The data lines (e.g., DL_1, DL_2, etc.) and the scan lines (e.g., SL_1, SL_2, etc.) are interlaced to form a plurality of display units 50 in the display area 40. Each display unit 50 includes an AMOLED circuit. The AMOLED circuit includes transistors T1 and T2, a capacitor C and an organic light emitting diode D, which are connected as shown in FIG. 1.

The scan driver 30 sequentially sends scan signals to the scan lines, e.g., SL_1, SL_2, etc., so as to only turn on the transistors T1 of all the display units 50 on a certain row and turn off the transistors T1 of all the display units 50 on other rows in one period. The data driver 20 sends data signals corresponding to the image data to be displayed to the display units 50 on the row through the data lines, e.g., DL_1, DL_2, etc. When the transistors T1 of the display units are turned on by the scan signals, the data signals are read into the capacitor C. At this time, a driving current I generated by the transistors T2 enable the light emitting diode D to emit light can be calculated from the following equation:

$$I=\tfrac{1}{2}\beta(Vgs_T2-|Vth_T2|)^2$$

In the above-mentioned equation, β is a constant, Vgs_T2 is a voltage difference between the gate electrode and the source electrode of the transistor T2, and Vth_T2 is a threshold voltage of the transistor T2. Since the transistors T2 in different display units 50 have different threshold voltages due to variances between the manufacturing processes, the driving currents I are different accordingly. The differences in the driving currents I lead to the uneven luminance of the organic light emitting diodes D, and causing uneven brightness on the screen when the AMOLED displayer 10 displays images.

SUMMARY

An aspect of the disclosure provides an active matrix organic light emitting diode (AMOLED) circuit. The AMOLED circuit includes an organic light emitting diode, a first capacitor, a second capacitor, a first transistor, a second transistor, a third transistor, a fourth transistor, a fifth transistor and a sixth transistor. The cathode of the organic light emitting diode is connected to a first power supply. The first capacitor has a first end and a second end. The second capacitor has a first end and a second end. The first end of the second capacitor is connected to the first end of the first capacitor. The first transistor has a first end, a second end and a control end. The first end of the first transistor is connected to the organic light emitting diode. The control end of the first transistor is connected to a control line. The second transistor has a first end, a second end and a control end. The first end of the second transistor is connected to the second end of the first capacitor. The second end of the second transistor is connected to a reference power supply. The control end of the second transistor is connected to a second power supply. The third transistor has a first end, a second end and a control end. The first end of the third transistor is connected to the first end of the first capacitor. The second end of the third transistor is connected to a signal input line. The control end of the third transistor is connected to a first scan line. The fourth transistor has a first end, a second end and a control end. The first end of the fourth transistor is connected to the reference power supply. The second end of the fourth transistor is connected to the first end of the first capacitor. The control end of the fourth transistor is connected to a second scan line. The fifth transistor has a first end, a second end and a control end. The first end of the fifth transistor is connected to the second end of the first capacitor. The second end of the fifth transistor is connected to the second end of the first transistor. The control end of the fifth transistor is connected to the second scan line. The sixth transistor has a first end, a second end and a control end. The first end of the sixth transistor is connected to the second end of the first transistor. The second end of the sixth transistor is connected to the second power supply. The control end of the sixth transistor is connected to the second end of the first capacitor.

Another aspect of the disclosure provides an AMOLED circuit which includes an organic light emitting diode, a switching circuit, a compensating circuit, a driving circuit and a reset circuit. The switching circuit is connected to the organic light emitting diode. The compensating circuit is connected to the switching circuit and includes a first capacitor. The driving circuit is connected to the switching circuit and the compensating circuit and is configured to be driven by the compensating circuit, so as to provide the organic light emitting diode with a driving current. The reset circuit is connected to both ends of the first capacitor and to a control line. The reset circuit is configured to change the voltage levels on both ends of the first capacitor according to the voltage level on the control line, such that one end of the first capacitor is conducted to a reference power supply, and charges stored inside the first capacitor are released.

Still another aspect of the disclosure provides an operating method of an AMOLED circuit. The AMOLED circuit includes an organic light emitting diode, a driving circuit, a switching circuit, a compensating circuit and a reset circuit. The compensating circuit includes a first capacitor. The driving circuit includes a first transistor. The first transistor has a first end, a second end and a control end. The operating method includes the following steps. The voltage level on a control line coupled to the reset circuit is changed so as to change the voltage levels on both ends of the first capacitor, such that one end of the first capacitor and a reference power supply are conducted, and charges stored inside the first capacitor are released. The compensating circuit is controlled such that the first end of the first transistor and the control end of the first transistor are conducted, the first end of the first capacitor is conducted to the reference power supply, and the second end of the first capacitor is conducted to the control end of the first transistor. The compensating circuit is controlled such that the first end of the first capacitor is conducted to a signal input line. The compensating circuit and the voltage level on the control line is controlled such that the first transistor is driven by the voltage level on the second end of the first capacitor to generate a driving current, to enable the organic light emitting diode to emit light.

BRIEF DESCRIPTION OF THE DRAWINGS

In order to make the aspects, features, advantages and embodiments of the disclosure more apparent, the accompanying drawings are described as follows.

DETAILED DESCRIPTION

The spirit of the disclosure will be illustrated clearly with reference to the accompanying drawings and detailed description as follows. After those of skills in the art learn the embodiments of the disclosure, with the technology taught in the disclosure, modifications and variations can be made, without departing from the spirit and scope of the disclosure.

For the term "couple" or "connect" used herein, both of them can refer to the physical contact or electrical contact performed directly or indirectly between two or more elements. The term "couple" or "connect" can further refer to the interoperation or interaction between two or more elements.

Figure 1:
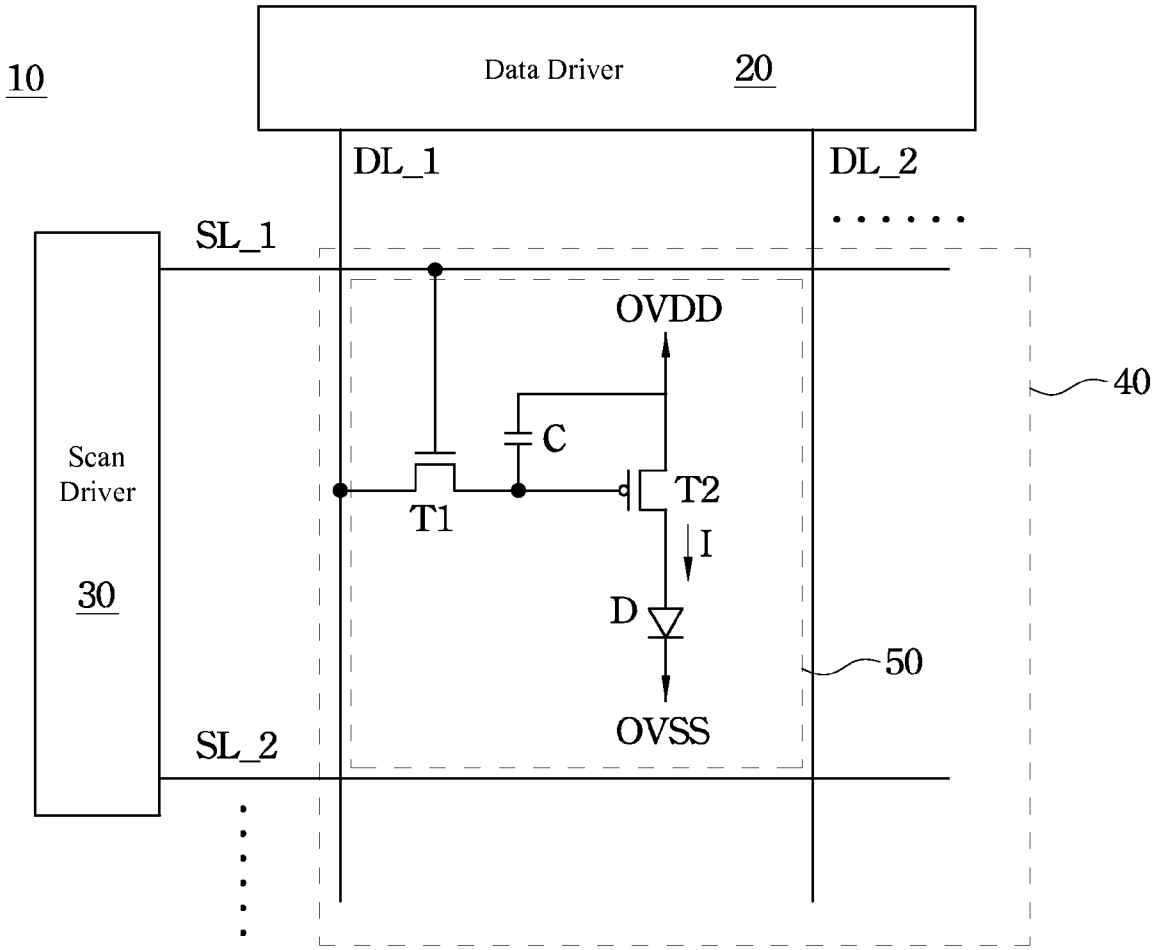
Fig. 1 (PRIOR ART)
FIG. 1 is a schematic diagram of an active matrix organic light emitting diode (AMOLED) displayer of the prior art.
Figure 2:
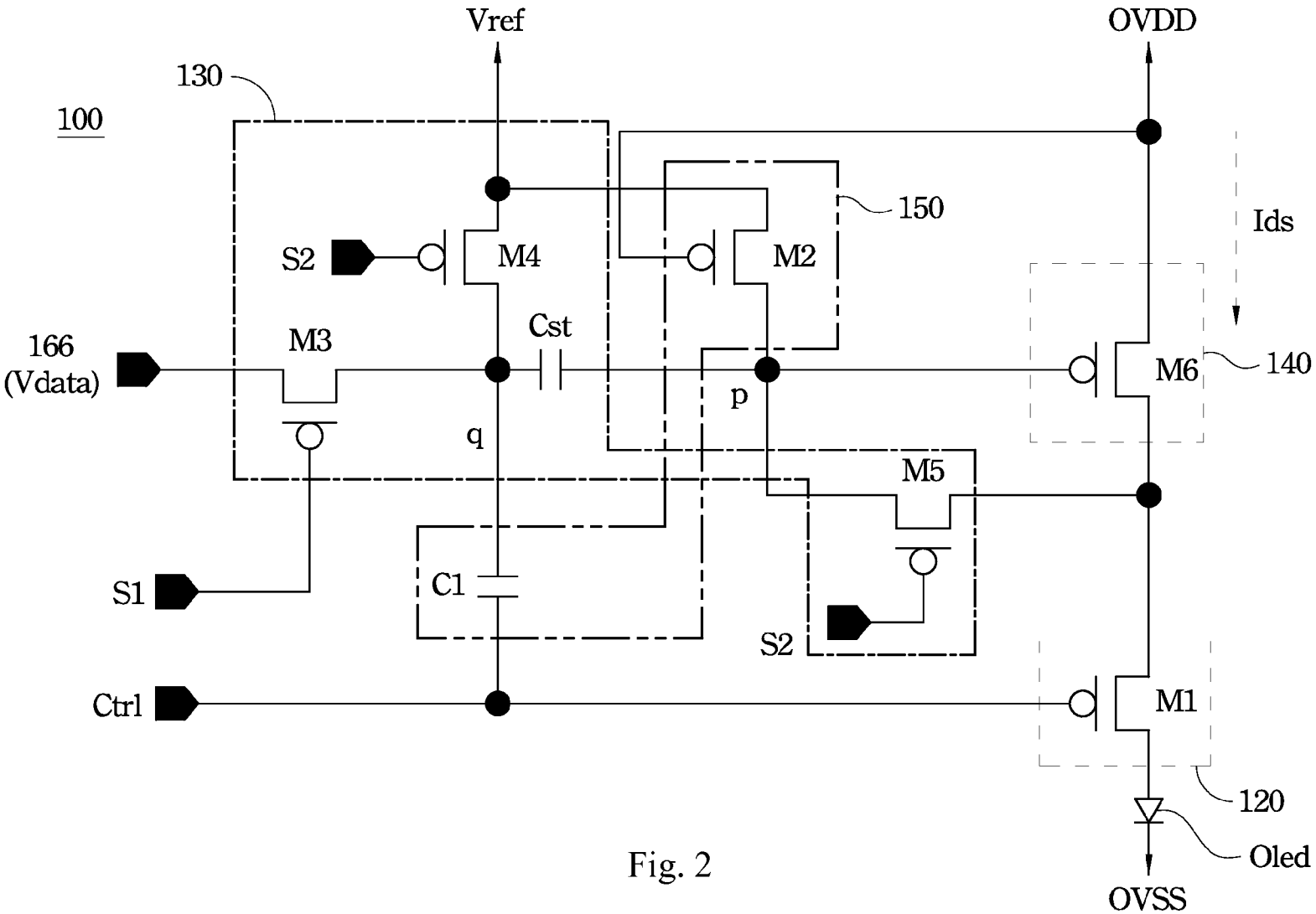
FIG. 2 is a schematic diagram of an AMOLED circuit according to an embodiment of the disclosure.

FIG. 2 is a schematic diagram of an active matrix organic light emitting diode (AMOLED) circuit 100 illustrated according to an embodiment of the disclosure. The AMOLED circuit 100 can be used in the AMOLED displayer (e.g., being used as an AMOLED pixel circuit in the displayer). The AMOLED displayer can include a data driver, a scan driver, a signal input line (or referred to as data line), a scan line and a display area formed by a plurality of display units arranged as a matrix. Each display unit includes the AMOLED circuit 100. When the scan driver sequentially turns on the AMOLED circuit 100 on each row through the scan line, the data signal is also written into the AMOLED circuit 100 on each row by the data driver through the signal input line, so as to enable the organic light emitting diodes (e.g., an organic light emitting diode Oled shown in FIG. 2) in the AMOLED circuit 100 to emit light.

As shown in FIG. 2, the AMOLED circuit 100 includes an organic light emitting diode Oled, a switching circuit 120, a compensating circuit 130, a driving circuit 140 and a reset circuit 150. The switching circuit 120 is connected to the organic light emitting diode Oled. The compensating circuit 130 is connected to the switching circuit 120 and includes a capacitor Cst. The driving circuit 140 is connected to the switching circuit 120 and the compensating circuit 130 and is configured to be driven by the compensating circuit 130 so as to provide the organic light emitting diode Oled with a driving current Ids. The organic light emitting diode Oled is configured to be driven by the driving current Ids to emit light. The reset circuit 150 is connected to both ends of the capacitor Cst and to a control line Ctrl. The reset circuit 150 is configured to change the voltage levels on both ends of the capacitor Cst according to the voltage level on the control line Ctrl, such that one end of the capacitor Cst and a reference power supply Vref can be conducted, charges stored inside the capacitor Cst can be released.

In this embodiment, the switching circuit 120 includes a transistor M1. The compensating circuit 130 includes a capacitor Cst, a transistor M3, a transistor M4 and a transistor M5. The driving circuit 140 includes a transistor M6. The reset circuit 150 includes a capacitor C1 and a transistor M2. The transistors M1-M6 all include a first end, a second end and a control end.

For structure, the cathode of the organic light emitting diode Oled is connected to a power supply OVSS. The first end of the capacitor Cst is connected to the first end of the capacitor C1. The first end of the transistor M1 is connected to the organic light emitting diode Oled. The control end of the transistor M1 is connected to the control line Ctrl. The first end of the transistor M2 is connected to the second end of the capacitor Cst. The second end of the transistor M2 is connected to the reference power supply Vref. The control end of the transistor M2 is connected to a power supply OVDD. The first end of the transistor M3 is connected to the first end of the capacitor Cst. The second end of the transistor M3 is connected to a signal input line (e.g., data line) 166 and receives a data signal Vdata transmitted by the signal input line 166. The control end of the transistor M3 is connected to a scan line S1. The first end of the transistor M4 is connected to the reference power supply Vref. The second end of the transistor M4 is connected to the first end of the capacitor Cst. The control end of the transistor M4 is connected to a scan line S2. The first end of the transistor M5 is connected to the second end of the capacitor Cst. The second end of the transistor M5 is connected to the second end of the transistor M1. The control end of the transistor M5 is connected to the scan line S2. The first end of the transistor M6 is connected to the second end of the transistor M1. The second end of the transistor M6 is connected to the power supply OVDD. The control end of the transistor M6 is connected to the second end of the capacitor Cst.

In this embodiment, the transistors M1-M6 may be, but not limited to P-type transistors. It will be apparent to those of skills in the art that a part or all of the transistors in the AMOLED circuit 100 also can be practiced by use of N-type transistors.

Figure 3A:
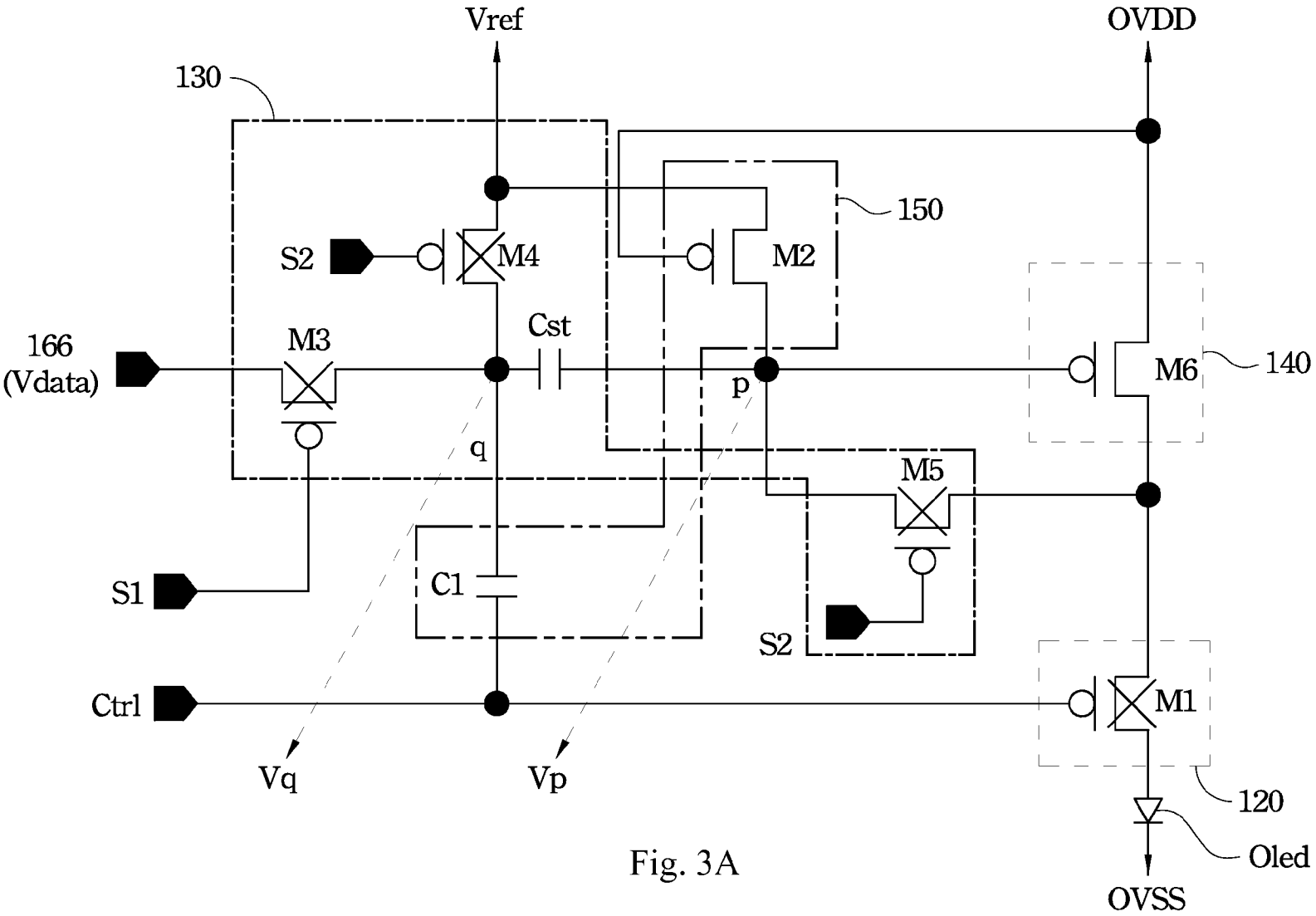
FIG. 3A is a schematic operating diagram of the AMOLED circuit illustrated in FIG. 2 during an operation period.
Figure 3B:
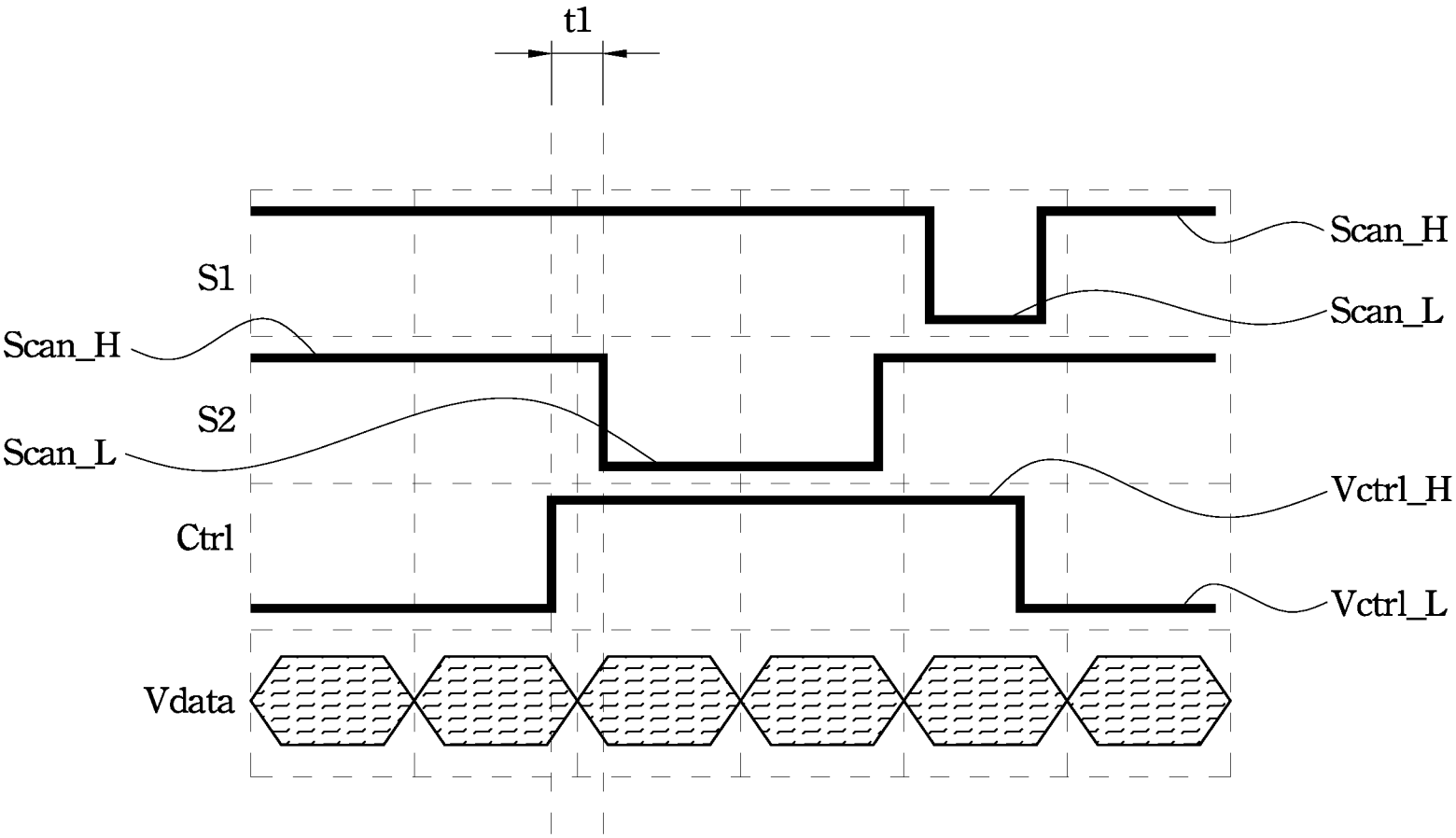
FIG. 3B is an operating timing diagram of the AMOLED circuit illustrated in FIG. 3A.

FIG. 3A is a schematic operating diagram of the AMOLED circuit 100 illustrated in FIG. 2 during an operation period (e.g., during the discharge period). FIG. 3B is an operating timing diagram of the AMOLED circuit 100 illustrated in FIG. 3A. As shown in FIGS. 3A and 3B, during the period of t1, the AMOLED circuit 100 is operated under an operating status (e.g., discharge status). The voltage level on the scan line S1 is a scan voltage level Scan_H such that the transistor M3 is turned off, and the voltage level on the scan line S2 is the scan voltage level Scan_H such that the transistors M4 and M5 are turned off. At this time, when the voltage level on the control line Ctrl is converted from a control voltage level Vctrl_L to a control voltage level Vctrl_H, a voltage level Vq on the second end (node q) of the capacitor C1 is accordingly increased due to the control voltage level is converted to Vctrl_H. When the voltage level Vq on the second end (node q) of the capacitor C1 is increased, a voltage level Vp on the second end (node p) of the capacitor Cst is increased (boosted) accordingly. If the voltage level Vp is greater than the sum of a voltage level of the power supply OVDD and a threshold voltage Vth_M2 of the transistor M2, i.e., Vp>OVDD+Vth_M2, the transistor M2 is turned on, such that the second end (node p) of the capacitor Cst can be conducted to the reference power supply Vref, and therefore charges stored inside the capacitor Cst can be released through a conducting path formed between the capacitor Cst and the reference power supply Vref. By releasing charges stored inside the capacitor Cst as above described, the capacitor Cst can be charged in the following operation periods easily, and image retention can be avoided when the AMOLED displayer displays images.

Figure 4A:
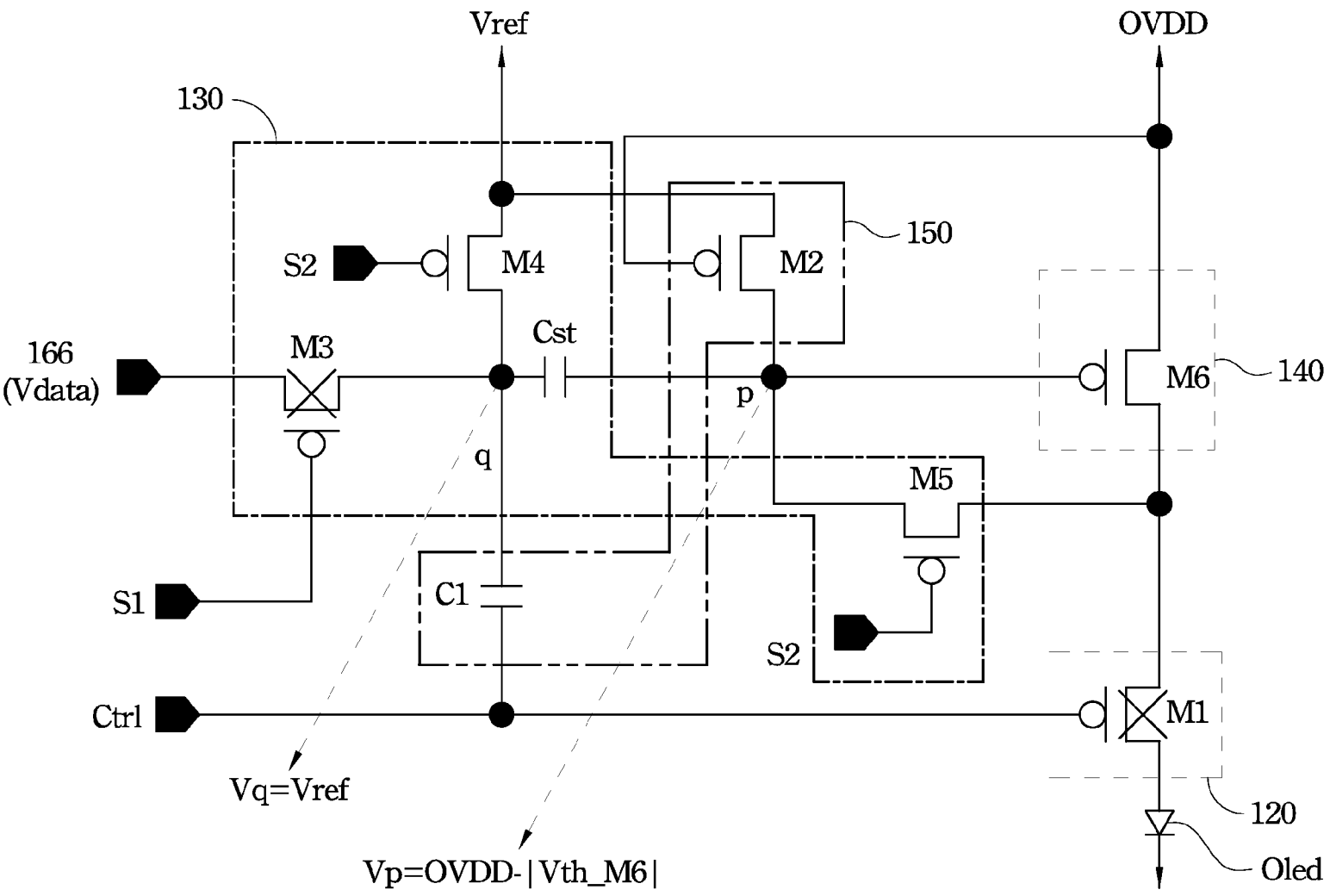
FIG. 4A is a schematic operating diagram of the AMOLED circuit illustrated in FIG. 2 during another operation period.
Figure 4B:
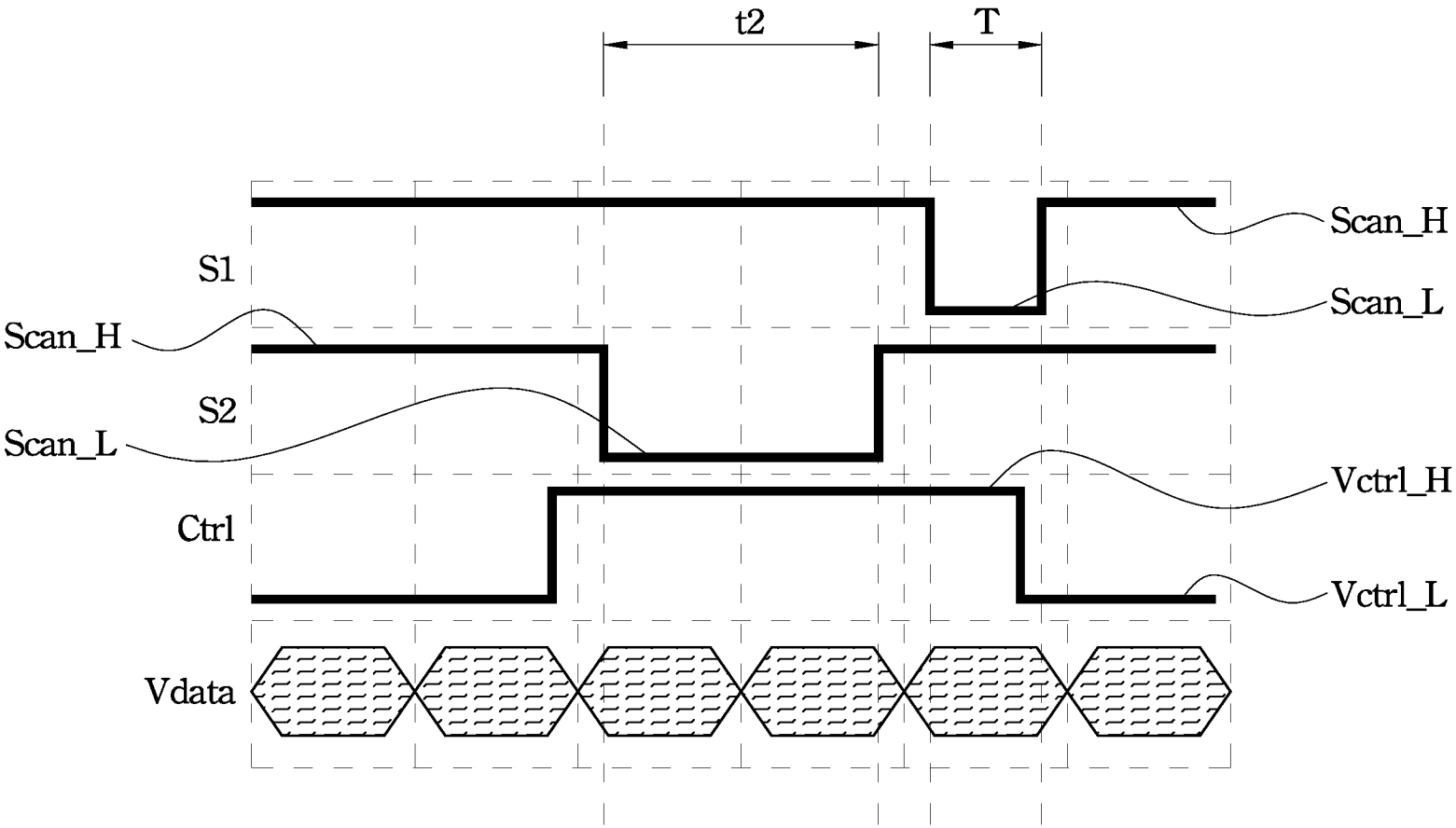
FIG. 4B is an operating timing diagram of the AMOLED circuit illustrated in FIG. 4A.

FIG. 4A is a schematic operating diagram of the AMOLED circuit 100 illustrated in FIG. 2 during another operation period (e.g., during the compensation period). FIG. 4B is an operating timing diagram of the AMOLED circuit 100 illustrated in FIG. 4A. As shown in FIG. 4A and FIG. 4B, during the period of t2, the AMOLED circuit 100 is operated under another operating status (e.g., compensation status), and the voltage level on the scan line S1 is the scan voltage level Scan_H such that the transistor M3 is turned off. At this time, when the voltage level on the scan line S2 is converted from the scan voltage level Scan_H to the scan voltage level Scan_L, the transistor M4 is turned on such that the reference power supply Vref can be conducted to the first end (node q) of the capacitor Cst. Meanwhile, the transistor M5 is turned on such that the first end of the transistor M6 and the control end of the transistor M6 are conducted, and the first end of the transistor M6 and the control end of the transistor M6 are conducted to the second end (node p) of the capacitor Cst. At this time, the voltage level Vq on the first end (node q) of the capacitor Cst is the voltage level on the reference power supply Vref, and the voltage level Vp on the second end (node p) of the capacitor Cst is converted from the voltage level of the reference power supply Vref to OVDD−|Vth_M6|, wherein Vth_M6 is the threshold voltage of the transistor M6. Accordingly, in this operation period, the threshold voltage Vth_M6 of the transistor M6 can be stored (or referred to as recorded) in the capacitor Cst such that the driving current generated by the transistor M6 in the following light-emitting period can be compensated, and the driving current can be kept from being influenced by the threshold voltage of the transistor M6.

Additionally, in some AMOLED displayers with high resolution or high scan frequency, the line time in which the data signal transmitted by the signal input lines 166 written into the capacitors Cst of the AMOLED circuits 100 on each row is often too short to charge the capacitor Cst sufficiently. Accordingly, in this embodiment, by controlling the time in which the voltage level on the scan line S2 is maintained as the scan voltage level Scan_L, the above-mentioned period of t2 (i.e., the time in which the first end of the transistor M6 and the control end of the transistor M6 are conducted) can be longer than a line time T (e.g., be double of the line time), such that the voltage level Vq on the first end (node q) and the voltage level Vp on the second end (node p) of the capacitor Cst can have enough time to be charged respectively to Vref and OVDD−|Vth_M6|. In such way, the driving current generated by the transistor M6 in the following light-emitting period can be compensated fully, and the driving current can be kept from being influenced by the threshold voltage level of the transistor M6.

The above-mentioned "line time" mainly refers to the time in which the data signal Vdata transmitted by the signal input line 166 written into the capacitor Cst of the AMOLED circuit 100 on each row. In this embodiment, the line time can be the time in which the voltage level on the scan line S1 is maintained as the scan voltage level Scan_L during the subsequent operation period.

Additionally, during the period of t2, the voltage level on the control line Ctrl is the control voltage level Vctrl_H so that the transistor M1 is turned off and the organic light emitting diode Oled does not emit light.

Figure 5A:
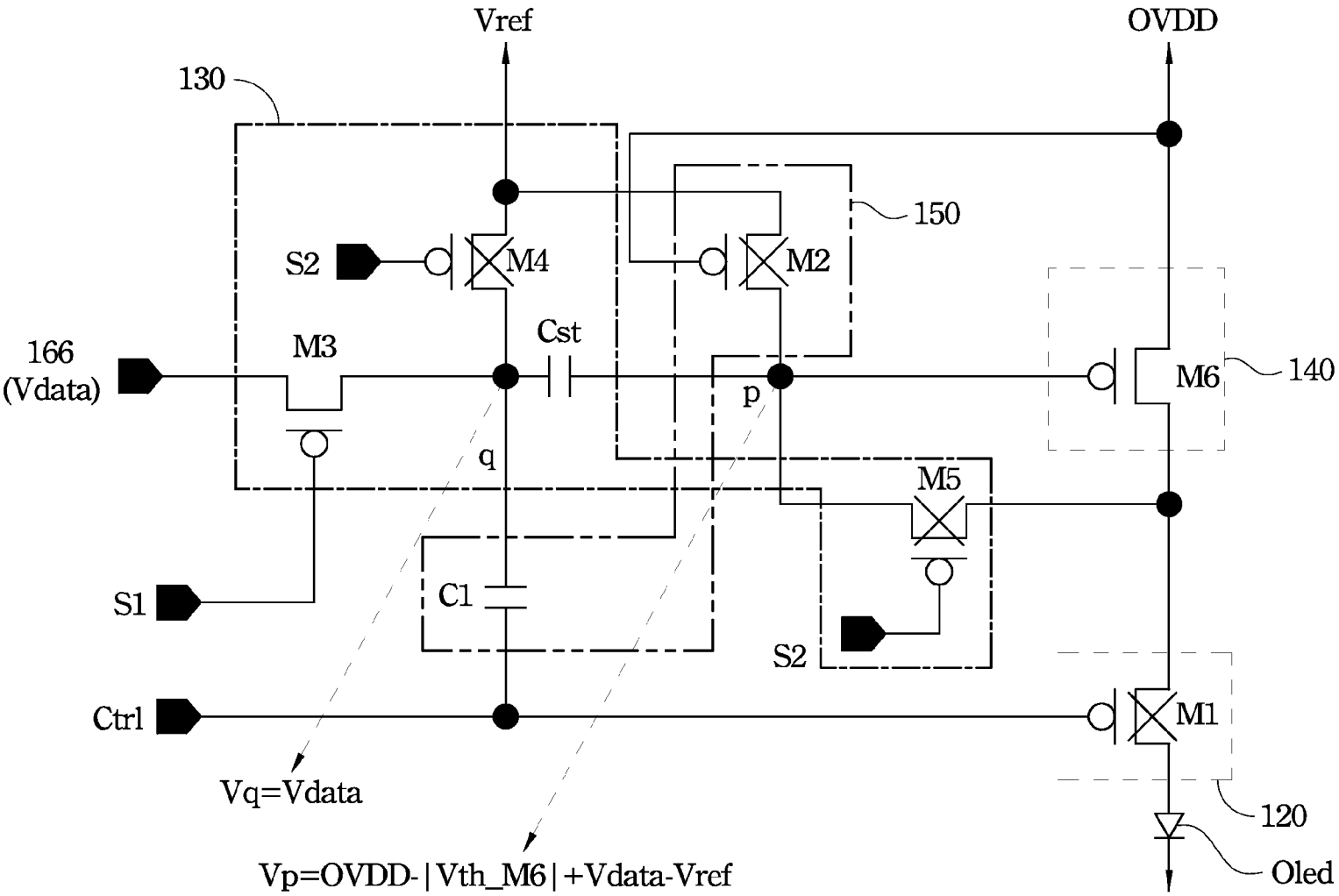
FIG. 5A is a schematic operating diagram of the AMOLED circuit illustrated in FIG. 2 during still another operation period.
Figure 5B:
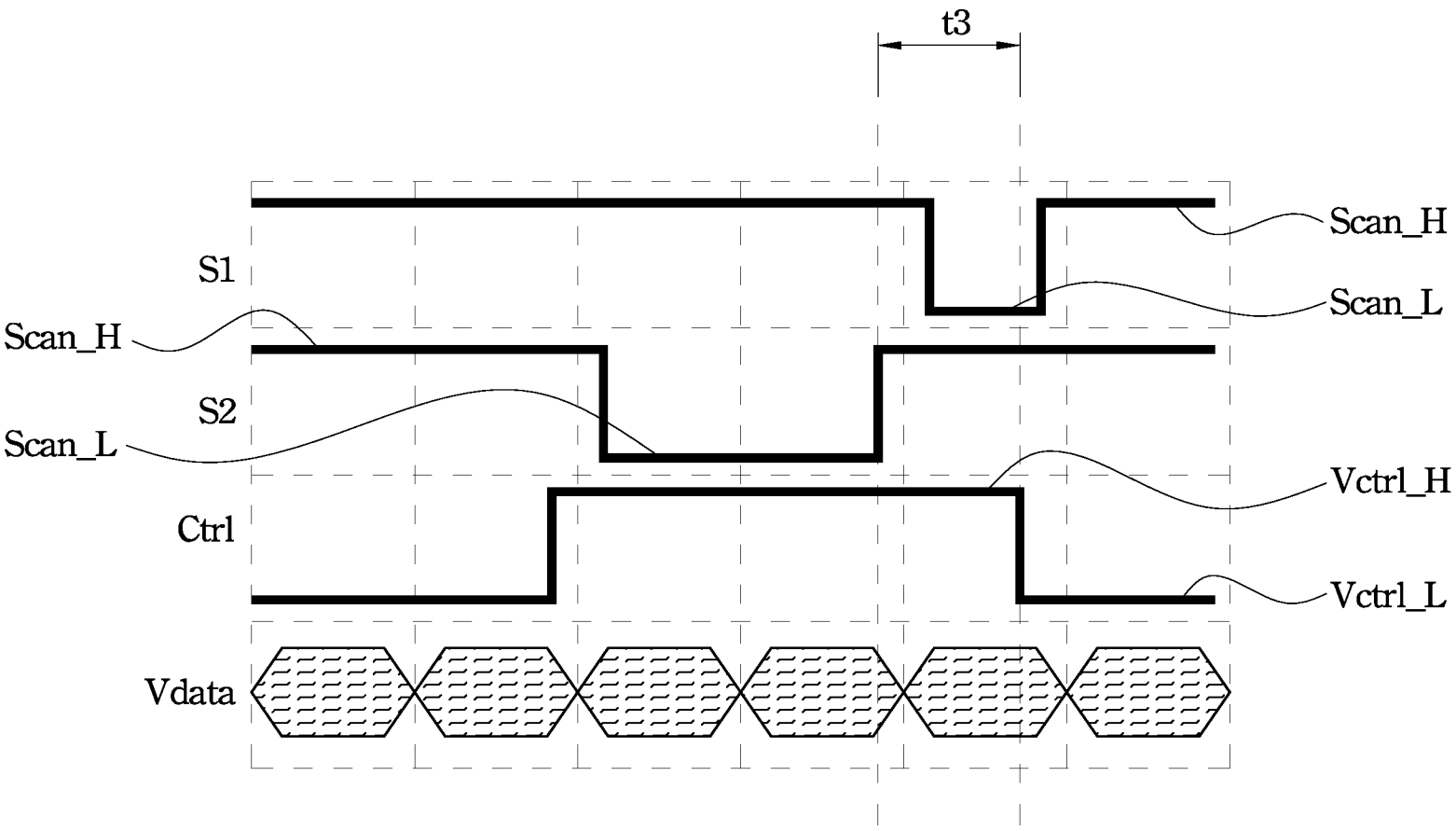
FIG. 5B is an operating timing diagram of the AMOLED circuit illustrated in FIG. 5A.

FIG. 5A is a schematic operating diagram of the AMOLED circuit 100 illustrated in FIG. 2 during still another operation period (e.g., during the data writing period). FIG. 5B is an operating timing diagram of the AMOLED circuit 100 illustrated in FIG. 5A. As shown in FIGS. 5A and 5B, during the period of t3, the AMOLED circuit 100 is operated under still another operating status (e.g., the data writing status), and the voltage level on the scan line S2 is converted from the scan voltage level Scan_L to the scan voltage level Scan_H such that the transistors M4 and M5 are turned off. Then, the voltage level on the scan line S1 is converted from the scan voltage level Scan_H to the scan voltage level Scan_L such that the transistor M3 is turned on. At this time, the voltage level on the signal input line 166 (i.e., the data signal Vdata transmitted by the signal input line 166) is applied to the first end (node q) of the capacitor Cst such that the voltage level Vq on the first end (node q) of the capacitor Cst is converted from Vref to Vdata. Since the voltage level Vq on node q varies from Vref to Vdata, the second end (node p) of the capacitor Cst also has substantially the same variation, and therefore Vp becomes OVDD−|Vth_M6|+Vdata−Vref. In this operating period, the data signal Vdata can be written into the capacitor Cst. Additionally, at this time, the voltage level on the control line Ctrl is the control voltage level Vctrl_H so that the transistor M1 is turned off and the organic light emitting diode Oled does not emit light.

Figure 6A:
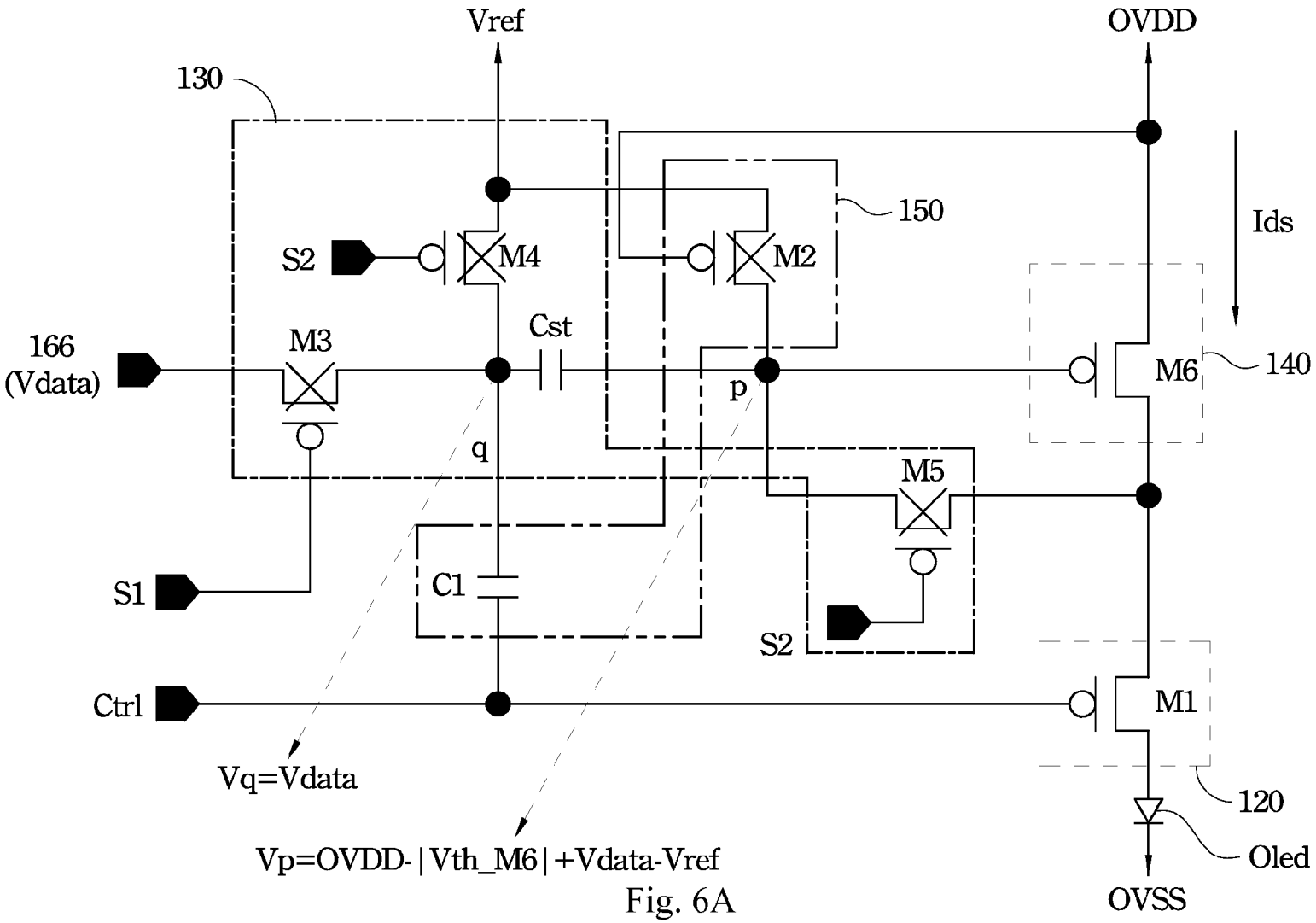
FIG. 6A is a schematic operating diagram of the AMOLED circuit illustrated in FIG. 2 during yet still another operation period.
Figure 6B:
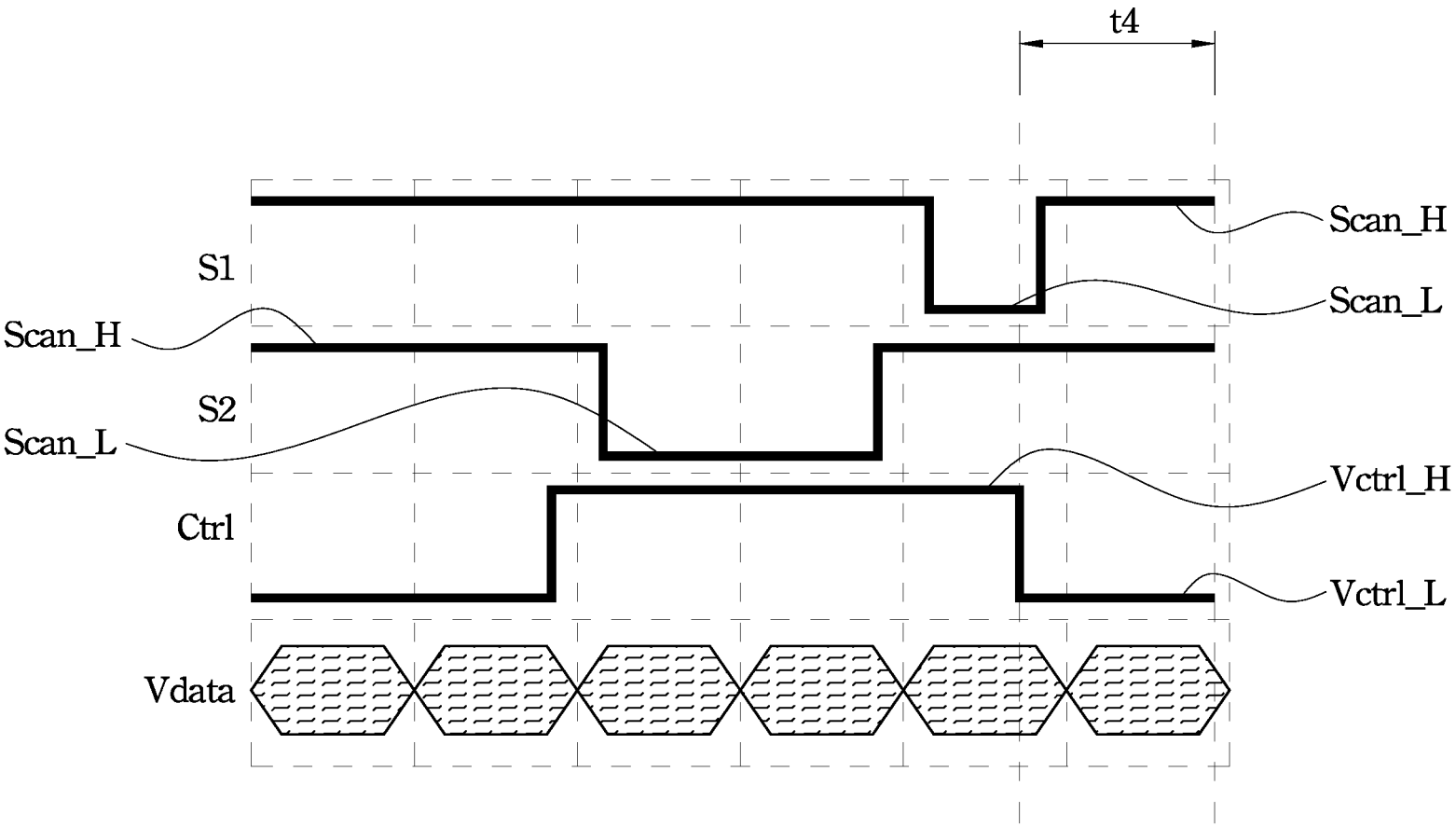
FIG. 6B is an operating timing diagram of the AMOLED circuit illustrated in FIG. 6A.

FIG. 6A is a schematic operating diagram of the active matrix organic light emitting diode circuit 100 illustrated in FIG. 2 during yet still another operation period (e.g., during the light-emitting period). FIG. 6B is an operating timing diagram of the AMOLED circuit 100 illustrated in FIG. 6A. As shown in FIGS. 6A and 6B, during the period of t4, the AMOLED circuit 100 is operated under still another operating status (e.g., the light-emitting status), and the voltage level on the scan line S2 is the scan voltage level Scan_H. While the voltage level on the control line Ctrl is converted from the control voltage level Vctrl_H to the control voltage level Vctrl_L, the transistor M1 is turned on such that the first end of the transistor M6 can be conducted to the anode of the organic light emitting diode Oled, and the transistor M6 can be driven by the voltage level Vp=Vdata−Vref+OVDD−|Vth_M6| on the second end (node p) of the capacitor Cst to generate the driving current Ids so as to enable the organic light emitting diode Oled to emit light. The value of the driving current Ids can be obtained from the following equation.

$$Ids = 1/2\ \beta(Vsg - |Vth_M6|)^2$$
$$= 1/2\ \beta(Vp - OVDD - |Vth_M6|)^2$$
$$= 1/2\ \beta(Vdata - Vref)^2$$

In the above-mentioned equation, β is a constant. From the above-mentioned equation, it can be seen that the driving current Ids of the organic light emitting diode Oled is not influenced by the threshold voltage Vth_M6 of the transistor M6. Accordingly, even if the transistor M6 has different threshold voltages causing by the variances in the manufacturing process, the luminance of the organic light emitting diode would not be changed. Therefore, if this AMOLED circuit is used in the AMOLED displayer, the issue of uneven brightness will be reduced when the displayer displays images.

Additionally, during the period of t4, after the voltage level on the control line Ctrl is converted from the control voltage level Vctrl_H to the control voltage level Vctrl_L, the voltage level on the scan line S1 is also converted from the scan voltage level Scan_L to the scan voltage level Scan_H such that the transistor M3 is turned off.

Figure 7:
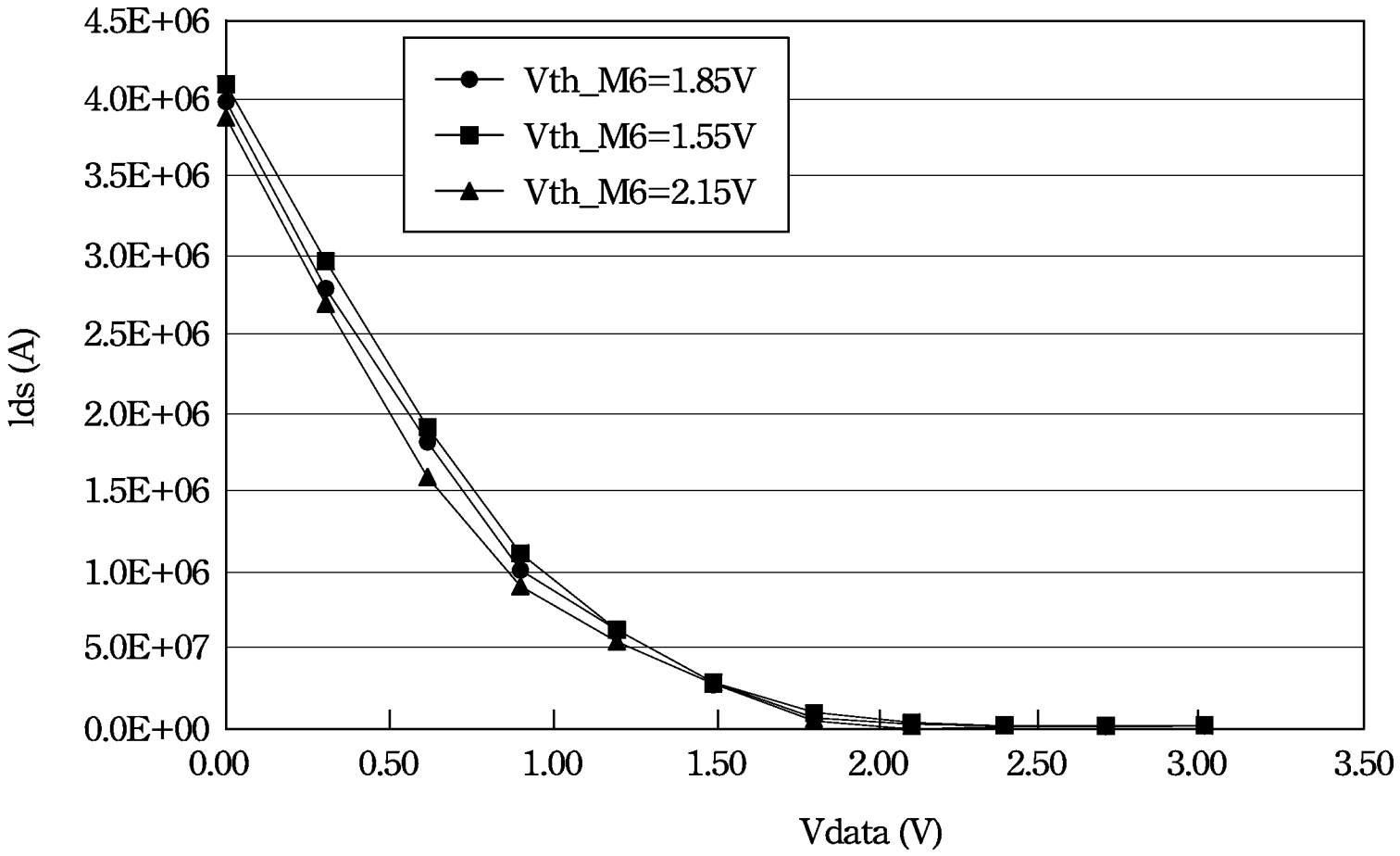
FIG. 7 is a measurement result of the variation relationship between the driving current and the data signal transmitted by the signal input line under different threshold voltages of the transistor M6 in the AMOLED circuit shown in FIG. 2.

FIG. 7 is a measurement result of the variation relationship between the driving current Ids and the data signal Vdata transmitted by the signal input line 166 under different threshold voltages of the transistor M6 in the AMOLED circuit 100 shown in FIG. 2. As shown in FIG. 7, when the threshold voltage Vth_M6 of the transistor M6 is alternatively −1.85 V, −1.55 V and −2.15 V, the relationships between the data signal Vdata transmitted by the signal input line 166 and the driving current Ids are almost the same, which are not changed due to the different threshold voltages of the transistor M6.

Another aspect of the disclosure provides an operating method of an active matrix organic light emitting diode (AMOLED) circuit. This operating method can be used to operate an AMOLED circuit which has the same structure as or has the structure similar to the embodiment in FIG. 2, and thus it will not be illustrated herein. The operating method includes the following steps. For convenience in illustration, the following operating method is illustrated by taking the embodiments shown in FIGS. 3A, 4A, 5A and 6A as examples, although the disclosure is not limited to this.

Firstly, as shown in FIG. 3A, the voltage level on the control line Ctrl coupled to the reset circuit 150 is changed so as to change the voltage levels on both ends of the capacitor Cst, such that one end of the capacitor Cst and the reference power supply Vref are conducted, and charges stored inside the capacitor Cst are released. By doing so, the capacitor Cst can be charged in the subsequent steps easily, and image retention can be avoided when the AMOLED displayer displays images. Then, as shown in FIG. 4A, the compensating circuit 130 is controlled to conduct the first end of the transistor M6 to the control end of the transistor M6, such that the first end (node q) of the capacitor Cst can be conducted to the reference power supply Vref, and the second end (node p) of the capacitor Cst can be conducted to the control end of the transistor M6. In such way, the threshold voltage Vth_M6 of the transistor M6 can be stored (or referred to as recorded) in the capacitor Cst. Next, as shown in FIG. 5A, the compensating circuit 130 is controlled such that the first end of the capacitor Cst and the signal input line 166 are conducted, and the voltage level on the signal input line 166, i.e., the data signal Vdata, is written into the capacitor Cst. Finally, as shown in FIG. 6A, the compensating circuit 130 and the voltage level on the control line Ctrl are controlled such that the transistor M6 is driven by the voltage level Vp on the second end (node p) of the capacitor Cst to generate the driving current Ids to enable the organic light emitting diode Oled to emit light.

In an embodiment, as shown in FIGS. 3A and 3B, the step of changing the voltage level on the control line Ctrl coupled to the reset circuit 150 includes: converting the voltage level on the control line Ctrl from the control voltage level Vctrl_L to the control voltage level Vctrl_H such that the second transistor M2 is turned on by the voltage level Vp on the second end (node p) of the capacitor Cst, and the second end (node p) of the capacitor Cst is conducted to the reference power supply Vref to release charges stored inside the capacitor Cst.

In an embodiment, as shown in FIGS. 4A and 4B, the step of controlling the compensating circuit 130 such that the first end of the transistor M6 and the control end of the transistor M6 are conducted includes: converting the voltage level on the scan line S2 from the scan voltage level Scan_H to the scan voltage level Scan_L such that the transistor M4 and the transistor M5 are turned on.

In an embodiment, as shown in FIGS. 5A and 5B, the step of controlling the compensating circuit 130 such that the first end (node p) of the capacitor Cst is conducted to the signal input line 166 includes: converting the voltage level on the scan line S2 from the scan voltage level Scan_L to the scan voltage level Scan_H such that the transistor M4 and the transistor M5 are turned off, and then converting the voltage level on the scan line S1 from the scan voltage level Scan_H to the scan voltage level Scan_L such that the transistor M3 is turned on.

In an embodiment, as shown in FIGS. 6A and 6B, the step of controlling the compensating circuit 130 and the voltage level on the control line Ctrl such that the transistor M6 is driven by the voltage level Vp on the second end (node p) of the capacitor Cst to generate the driving current Ids includes: converting the voltage level on the control line Ctrl from the control voltage level Vctrl_H to the control voltage level Vctrl_L such that the transistor M1 is turned on, and then converting the voltage level on the scan line S1 from the scan voltage level Scan_L to the scan voltage level Scan_H such that the transistor M3 is turned off.

Through the above-mentioned steps, the driving current Ids which drives the organic light emitting diode Oled to emit light is not varied with the variance of the threshold voltage Vth_M6 of the transistor M6. Accordingly, if the above-mentioned method is used in the AMOLED circuit of the AMOLED displayer, the problem of uneven brightness could be avoided when the displayer displays images.

Although the disclosure has been disclosed with reference to the above embodiments, these embodiments are not intended to limit the disclosure. It will be apparent to those of skills in the art that various modifications and variations can be made without departing from the spirit and scope of the disclosure. Therefore, the scope of the disclosure shall be defined by the appended claims.

What is claimed is:

1. An active matrix organic light emitting diode circuit, comprising:

an organic light emitting diode, wherein a cathode of the organic light emitting diode is connected to a first power supply;

a first capacitor, having a first end and a second end;

a second capacitor, having a first end and a second end, wherein the first end of the second capacitor is connected to the first end of the first capacitor;

a first transistor, having a first end, a second end and a control end, wherein the first end of the first transistor is connected to the organic light emitting diode and the control end of the first transistor is connected to a control line;

a second transistor, having a first end, a second end and a control end, wherein the first end of the second transistor is connected to the second end of the first capacitor, the second end of the second transistor is connected to a reference power supply and the control end of the second transistor is connected to a second power supply;

a third transistor, having a first end, a second end and a control end, wherein the first end of the third transistor is connected to the first end of the first capacitor, the second end of the third transistor is connected to a signal input line and the control end of the third transistor is connected to a first scan line;

a fourth transistor, having a first end, a second end and a control end, wherein the first end of the fourth transistor is connected to the reference power supply, the second end of the fourth transistor is connected to the first end of the first capacitor and the control end of the fourth transistor is connected to a second scan line;

a fifth transistor, having a first end, a second end and a control end, wherein the first end of the fifth transistor is connected to the second end of the first capacitor, the second end of the fifth transistor is connected to the second end of the first transistor and the control end of the fifth transistor is connected to the second scan line; and a sixth transistor, having a first end, a second end and a control end, wherein the first end of the sixth transistor is connected to the second end of the first transistor, the second end of the sixth transistor is connected to the second power supply and the control end of the sixth transistor is connected to the second end of the first capacitor.

2. The active matrix organic light emitting diode circuit of claim 1, wherein when the voltage levels on the first scan line and the second scan line are second scan voltage levels and the voltage level on the control line is converted from a first control voltage level to a second control voltage level, the second transistor is turned on by the voltage level on the second end of the first capacitor such that the second end of the first capacitors is conducted to the reference power supply, and charges stored inside the first capacitor are released.

3. The active matrix organic light emitting diode circuit of claim 1, wherein when the voltage level on the first scan line is a second scan voltage level and the voltage level on the second scan line is converted from a second scan voltage level into a first scan voltage level, the fourth transistor is turned on such that the reference power supply is conducted to the first end of the first capacitor, and the fifth transistor is turned on such that the first end of the sixth transistor is conducted to the control end of the first transistor and the first end of the sixth transistor and the control end of the sixth transistor are conducted to the second end of the first capacitor.

4. The active matrix organic light emitting diode circuit of claim 1, wherein after the voltage level on the second scan line is converted from a first scan voltage level to a second scan voltage level and the voltage level on the first scan line is converted from a second scan voltage level to a first scan voltage level, the fourth transistor and the fifth transistor are turned off and the third transistor is turned on such that the voltage level on the signal input line is applied to the first end of the first capacitor.

5. The active matrix organic light emitting diode circuit of claim 1, wherein after the voltage level on the second scan line is converted from a first scan voltage level to a second scan voltage level and when the voltage level on the control line is converted from a second control voltage level to a first control voltage level, the first transistor is turned on such that the first end of the sixth transistor to is conducted to the anode of the organic light emitting diode and the sixth transistor is driven by the voltage level on the second end of the first capacitor to generate a driving current to enable the organic light emitting diode to emit light.

6. The active matrix organic light emitting diode circuit of claim 1, wherein the first transistor, the second transistor, the third transistor, the fourth transistor, the fifth transistor and the sixth transistor are P-type transistors.

7. An active matrix organic light emitting diode circuit, comprising:

an organic light emitting diode;

a switching circuit connected to the organic light emitting diode;

a compensating circuit connected to the switching circuit, wherein the compensating circuit comprises a first capacitor;

a driving circuit connected to the switching circuit and the compensating circuit, wherein the driving circuit is configured to be driven by the compensating circuit so as to provide the organic light emitting diode with a driving current; and a reset circuit connected to both ends of the first capacitor and to a control line, wherein the reset circuit comprises a second capacitor, wherein a first end of the second capacitor is connected to the first end of the first capacitor and a second end of the second capacitor is connected to the control line, wherein the reset circuit is configured to change the voltage levels on both ends of the first capacitor according to the voltage level on the control line, such that one end of the first capacitor and a reference power supply are conducted, and the charges stored inside the first capacitor are released.

8. The active matrix organic light emitting diode circuit of claim 7, wherein the switching circuit comprises:

a first transistor, having a first end, a second end and a control end, wherein the first end of the first transistor is connected to the anode of the organic light emitting diode, the second end of the first transistor is connected to the driving circuit, the control end of the first transistor is connected to the control line, and the cathode of the organic light emitting diode is connected to a first power supply.

9. The active matrix organic light emitting diode circuit of claim 8, wherein the first transistor is a P-type transistor.

10. The active matrix organic light emitting diode circuit of claim 7, wherein the reset circuit comprises a second transistor, having a first end, a second end and a control end, wherein the first end of the second transistor is connected to the second end of the first capacitor, the second end of the second transistor is connected to a reference power supply and the control end of the second transistor is connected to a second power supply.

11. The active matrix organic light emitting diode circuit of claim 10, wherein when the voltage level on the control line is converted from a first control voltage level to a second control voltage level, the second transistor is turned on by the voltage level on the second end of the first capacitor, such that the second end of the first capacitor to is conducted to the reference power supply, and charges stored inside the first capacitor are released.

12. The active matrix organic light emitting diode circuit of claim 7, wherein the compensating circuit further comprises:

a third transistor, having a first end, a second end and a control end, wherein the first end of the third transistor is connected to the first end of the first capacitor, the second end of the third transistor is connected to a signal input line and the control end of the third transistor is connected to a first scan line;

a fourth transistor, having a first end, a second end and a control end, wherein the first end of the fourth transistor is connected to a reference power supply, the second end of the fourth transistor is connected to the first end of the first capacitor and the control end of the fourth transistor is connected to a second scan line; and a fifth transistor, having a first end, a second end and a control end, wherein the first end of the fifth transistor is connected to the second end of the first capacitor, the second end of the fifth transistor is connected to the driving circuit and the control end of the fifth transistor is connected to the second scan line.

13. The active matrix organic light emitting diode circuit of claim 12, wherein the driving circuit comprises:

a sixth transistor, having a first end, a second end and a control end, wherein the first end of the sixth transistor is connected to the second end of the first transistor, the second end of the sixth transistor is connected to a second power supply and the control end of the sixth transistor is connected to the second end of the first capacitor.

14. The active matrix organic light emitting diode circuit of claim 13, wherein the third transistor, fourth transistor, fifth transistor and sixth transistor are P-type transistors.

15. An operating method of an active matrix organic light emitting diode circuit, wherein the active matrix organic light emitting diode circuit comprises an organic light emitting diode, a driving circuit, a switching circuit, a compensating circuit and a reset circuit, the compensating circuit comprises a first capacitor, the driving circuit comprises a first transistor and the first transistor has a first end, a second end and a control end, the operating method comprises:

changing the voltage level on a control line coupled to the reset circuit so as to change the voltage levels on both ends of the first capacitor, such that one end of the first capacitor and a reference power supply are conducted, and charges stored inside the first capacitor are release;

controlling the compensating circuit such that the first end of the first transistor and the control end of the first transistor are conducted, and the first end of the first capacitor is conducted to the reference power supply, and the second end of the first capacitor is conducted to the control end of the first transistor;

controlling the compensating circuit such that the first end of the first capacitor is conducted to a signal input line; and controlling the compensating circuit and the voltage level on the control line such that the first transistor is driven by the voltage level on the second end of the first capacitor to generate a driving current to enable the organic light emitting diode to emit light.

16. The operating method of claim 15, wherein the reset circuit comprises a second capacitor and a second transistor, the compensating circuit further comprises a third transistor, a fourth transistor and a fifth transistor and the switching circuit comprises a sixth transistor, wherein the second capacitor has a first end and a second end, wherein the first end of the second capacitor is connected to the first end of the first capacitor, the second end of the second capacitor is connected to the control line, wherein the second transistor has a first end, a second end and a control end, wherein the first end of the second transistor is connected to the second end of the first capacitor, the second end of the second transistor is connected to the reference power supply and the control end of the second transistor is connected to a second power supply, wherein the third transistor has a first end, a second end and a control end, wherein the first end of the third transistor is connected to the first end of the first capacitor, the second end of the third transistor is connected to the signal input line and the control end of the third transistor is connected to a first scan line, wherein the fourth transistor has a first end, a second end and a control end, wherein the first end of the fourth transistor is connected to the reference power supply, the second end of the fourth transistor is connected to the first end of the first capacitor and the control end of the fourth transistor is connected to a second scan line, wherein the fifth transistor has a first end, a second end and a control end, wherein the first end of the fifth transistor is connected to the second end of the first capacitor and the control end of the first transistor, the second end of the fifth transistor is connected to the first end of the first transistor and the control end of the fifth transistor is connected to the second scan line, wherein the sixth transistor has a first end, a second end and a control end, wherein the first end of the sixth transistor is connected to the organic light emitting diode, the second end of the sixth transistor is connected to the second end of the fifth transistor, the control end of the sixth transistor is connected to the control line, wherein the second end of the first transistor is connected to the second power supply and the cathode of the organic light emitting diode is connected to a first power supply, wherein changing the voltage level on the control line coupled to the reset circuit comprises: converting the voltage level on the control line from a first control voltage level to a second control voltage level such that the second transistor is turned on by the voltage level on the second end of the first capacitor, and the second end of the first capacitor conducted to the reference power supply, and charges stored by the first capacitor are released.

17. The operating method of claim 15, wherein the reset circuit comprises a second capacitor and a second transistor, the compensating circuit further comprises a third transistor, a fourth transistor and a fifth transistor and the switching circuit comprises a sixth transistor, wherein the second capacitor has a first end and a second end, wherein the first end of the second capacitor is connected to the first end of the first capacitor, the second end of the second capacitor is connected to the control line, wherein the second transistor has a first end, a second end and a control end, wherein the first end of the second transistor is connected to the second end of the first capacitor, the second end of the second transistor is connected to the reference power supply and the control end of the second transistor is connected to a second power supply, wherein the third transistor has a first end, a second end and a control end, wherein the first end of the third transistor is connected to the first end of the first capacitor, the second end of the third transistor is connected to the signal input line and the control end of the third transistor is connected to a first scan line, wherein the fourth transistor has a first end, a second end and a control end, wherein the first end of the fourth transistor is connected to the reference power supply, the second end of the fourth transistor is connected to the first end of the first capacitor and the control end of the fourth transistor is connected to a second scan line, wherein the fifth transistor has a first end, a second end and a control end, wherein the first end of the fifth transistor is connected to the second end of the first capacitor and the control end of the first transistor, the second end of the fifth transistor is connected to the first end of the first transistor and the control end of the fifth transistor is connected to the second scan line, wherein the sixth transistor has a first end, a second end and a control end, wherein the first end of the sixth transistor is connected to the organic light emitting diode, the second end of the sixth transistor is connected to the second end of the fifth transistor, the control end of the sixth transistor is connected to the control line, wherein the second end of the first transistor is connected to the second power supply and the cathode of the organic light emitting diode is connected to a first power supply, wherein controlling the compensating circuit such that the first end of the first transistor and the control end of the first transistor are conducted comprises: converting the voltage level on the second scan line from a second scan voltage level to a first scan voltage level such that the fourth transistor and the fifth transistor are turned on.

18. The operating method of claim 15, wherein the reset circuit comprises a second capacitor and a second transistor, the compensating circuit further comprises a third transistor, a fourth transistor and a fifth transistor and the switching circuit comprises a sixth transistor, wherein the second capacitor has a first end and a second end, wherein the first end of the second capacitor is connected to the first end of the first capacitor, the second end of the second capacitor is connected to the control line, wherein the second transistor has a first end, a second end and a control end, wherein the first end of the second transistor is connected to the second end of the first capacitor, the second end of the second transistor is connected to the reference power supply and the control end of the second transistor is connected to a second power supply, wherein the third transistor has a first end, a second end and a control end, wherein the first end of the third transistor is connected to the first end of the first capacitor, the second end of the third transistor is connected to the signal input line and the control end of the third transistor is connected to a first scan line, wherein the fourth transistor has a first end, a second end and a control end, wherein the first end of the fourth transistor is connected to the reference power supply, the second end of the fourth transistor is connected to the first end of the first capacitor and the control end of the fourth transistor is connected to a second scan line, wherein the fifth transistor has a first end, a second end and a control end, wherein the first end of the fifth transistor is connected to the second end of the first capacitor and the control end of the first transistor, the second end of the fifth transistor is connected to the first end of the first transistor and the control end of the fifth transistor is connected to the second scan line, wherein the sixth transistor has a first end, a second end and a control end, wherein the first end of the sixth transistor is connected to the organic light emitting diode, the second end of the sixth transistor is connected to the second end of the fifth transistor, the control end of the sixth transistor is connected to the control line, wherein the second end of the first transistor is connected to the second power supply and the cathode of the organic light emitting diode is connected to a first power supply, wherein controlling the compensating circuit such that the first end of the first capacitor is conducted to the signal input line comprises: converting the voltage level on the second scan line from the first scan voltage level to the second scan voltage level such that the fourth transistor and the fifth transistor are turned off, and then converting the voltage level on the first scan line from the second scan voltage level to the first scan voltage level such that the third transistor is turned on.

19. The operating method of claim 15, wherein the reset circuit comprises a second capacitor and a second transistor, the compensating circuit further comprises a third transistor, a fourth transistor and a fifth transistor and the switching circuit comprises a sixth transistor, wherein the second capacitor has a first end and a second end, wherein the first end of the second capacitor is connected to the first end of the first capacitor, the second end of the second capacitor is connected to the control line, wherein the second transistor has a first end, a second end and a control end, wherein the first end of the second transistor is connected to the second end of the first capacitor, the second end of the second transistor is connected to the reference power supply and the control end of the second transistor is connected to a second power supply, wherein the third transistor has a first end, a second end and a control end, wherein the first end of the third transistor is connected to the first end of the first capacitor, the second end of the third transistor is connected to the signal input line and the control end of the third transistor is connected to a first scan line, wherein the fourth transistor has a first end, a second end and a control end, wherein the first end of the fourth transistor is connected to the reference power supply, the second end of the fourth transistor is connected to the first end of the first capacitor and the control end of the fourth transistor is connected to a second scan line, wherein the fifth transistor has a first end, a second end and a control end, wherein the first end of the fifth transistor is connected to the second end of the first capacitor and the control end of the first transistor, the second end of the fifth transistor is connected to the first end of the first transistor and the control end of the fifth transistor is connected to the second scan line, wherein the sixth transistor has a first end, a second end and a control end, wherein the first end of the sixth transistor is connected to the organic light emitting diode, the second end of the sixth transistor is connected to the second end of the fifth transistor, the control end of the sixth transistor is connected to the control line, wherein the second end of the first transistor is connected to the second power supply and the cathode of the organic light emitting diode is connected to a first power supply, wherein controlling the compensating circuit and the voltage level on the control line such that the first transistor is driven by the voltage level on the second end of the first capacitor to generate a driving current to enable the organic light emitting diode to emit light comprises: converting the voltage level on the control line from the second control voltage level to the first control voltage level such that the sixth transistor is turned on, and then converting the voltage level on the first scan line from the first scan voltage level to the second scan voltage level such that the third transistor is turned off.

20. The operating method of claim 15, wherein a time in which the compensating circuit is controlled such that the first end of the first transistor and the control end of the first transistor are conducted is longer than a line time.

* * * * *